US012680785B2

(12) United States Patent
Citron

(10) Patent No.: US 12,680,785 B2
(45) Date of Patent: Jul. 14, 2026

(54) COMPENSATING FOR TEMPERATURE OF A BARREL IN BALLISTICS

(71) Applicant: Mannis Operations LLC, Jupiter, FL (US)

(72) Inventor: Jeffrey Citron, Jupiter, FL (US)

(73) Assignee: Mannis Operations LLC, Jupiter, FL (US)

( * ) Notice: Subject to any disclaimer, the term of this patent is extended or adjusted under 35 U.S.C. 154(b) by 121 days.

(21) Appl. No.: 18/385,339

(22) Filed: Oct. 30, 2023

(65) Prior Publication Data

US 2025/0137751 A1 May 1, 2025

(51) Int. Cl.
*F41G 3/08* (2006.01)
*F41G 3/26* (2006.01)

(52) U.S. Cl.
CPC *F41G 3/08* (2013.01); *F41G 3/26* (2013.01)

(58) Field of Classification Search
CPC ..... F41G 3/00; F41G 3/08; F41G 3/26
See application file for complete search history.

(56) References Cited

U.S. PATENT DOCUMENTS

| | | | | |
|---|---|---|---|---|
| 3,143,919 | A | 8/1964 | Estes | |
| 3,363,296 | A | 1/1968 | Duffield | |
| 3,440,923 | A | 4/1969 | Purdie | |
| 3,705,515 | A | 12/1972 | Lee | |
| 4,723,472 | A | 2/1988 | Lee | |
| 4,836,078 | A | 6/1989 | Lee | |
| 5,635,661 | A | 6/1997 | Tuftee | |
| 5,649,465 | A | 7/1997 | Beebe | |
| 6,050,169 | A | 4/2000 | Voros | |
| 6,397,720 | B1 | 6/2002 | Fox et al. | |
| 9,395,155 | B1 | 7/2016 | Bockmon | |
| 9,464,871 | B2 | 10/2016 | Bay | |
| 9,574,860 | B1 | 2/2017 | Mobley | |
| 10,794,676 | B1 | 10/2020 | Aerni | |
| 11,067,375 | B1 | 7/2021 | Helgason | |
| 11,333,473 | B2 | 5/2022 | Carper et al. | |
| 2011/0114725 | A1 | 5/2011 | Young | |
| 2012/0160081 | A1 | 6/2012 | Beebe | |
| 2016/0084617 | A1* | 3/2016 | Lyren | F41G 3/12 42/135 |
| 2020/0056870 | A1 | 2/2020 | Carper et al. | |
| 2022/0349676 | A1* | 11/2022 | Maguire | F41G 3/06 |

FOREIGN PATENT DOCUMENTS

| | | | | |
|---|---|---|---|---|
| WO | 9736701 | A1 | 10/1997 | |
| WO | WO-2019161053 | A2 * | 8/2019 | F41G 11/003 |
| WO | WO-2023057040 | A1 * | 4/2023 | G06T 3/40 |

* cited by examiner

*Primary Examiner* — Laura A Gudorf

(57) ABSTRACT

An apparatus, system, computer-readable medium, and/or process to measure, sense, or otherwise determine temperature of a gun barrel (e.g., temperature profile) and use that information to generate instructions to adjust aim of the gun before, during, or after (e.g., next shot) shooting the gun. For example, a gun includes several (e.g., 4, 5) temperature sensors within its barrel that measure the temperature profile of a gun barrel after it is shot (e.g., each time it is shot or after several shots); and these sensors provide their measurements to a processing unit (e.g., CPU, GPU) and the processing unit uses these temperature measurements to generate a temperature profile. In at least one embodiment, the temperature profile may then be used to generate one or more predictions and/or instructions for a user.

22 Claims, 6 Drawing Sheets

COMPENSATING FOR TEMPERATURE OF A BARREL IN BALLISTICS

CROSS-REFERENCE TO RELATED APPLICATIONS

This application incorporates by reference for all purposes the full disclosure of co-pending U.S. patent application Ser. No. 18/385,336, filed Oct. 30, 2023, entitled "MODIFYING A PROJECTILE CASING" and co-pending U.S. patent application Ser. No. 18/385,341, filed Oct. 30, 2023, entitled "COMPENSATING FOR PROJECTILE WEIGHT IN BALLISTICS."

TECHNICAL FIELD

The embodiments of the disclosure relate to compensating for temperature in ballistics. Specifically, the disclosed technology includes a system, method, apparatus, and computer-readable medium that generates instructions for a person (e.g., marksman) to adjust their aim for firing a projectile based, at least in part, on a temperature measurement of a barrel.

BACKGROUND

Ballistics includes the science of projectiles and firearms, such as the motion of objects (e.g., rounds of projectiles) that are driven forward. For example, ballistics includes the study of effects of firing a round for a projectile, where the round comprises a cartridge including a casing and the projectile (e.g., bullet, slug, or shot). There are many factors to consider when a firearm fires a projectile according to ballistics. For example, the exit speed of the bullet from a barrel, the shape of the bullet, the size of the bullet, and the material of the bullet can affect the round's trajectory. Also, properties of the barrel such as length, material, width, and design can affect the firing of a round, and these properties can impact trajectory. These are various factors a marksman can consider while aiming. However, a marksman can still consider these factors and have performance affected (e.g., missing a target, having less accuracy and/or consistency), as there are many factors to consider when firing a projectile. Accordingly, there exists a need to improve firing a round of a projectile.

DETAILED DESCRIPTION

Figure 1:
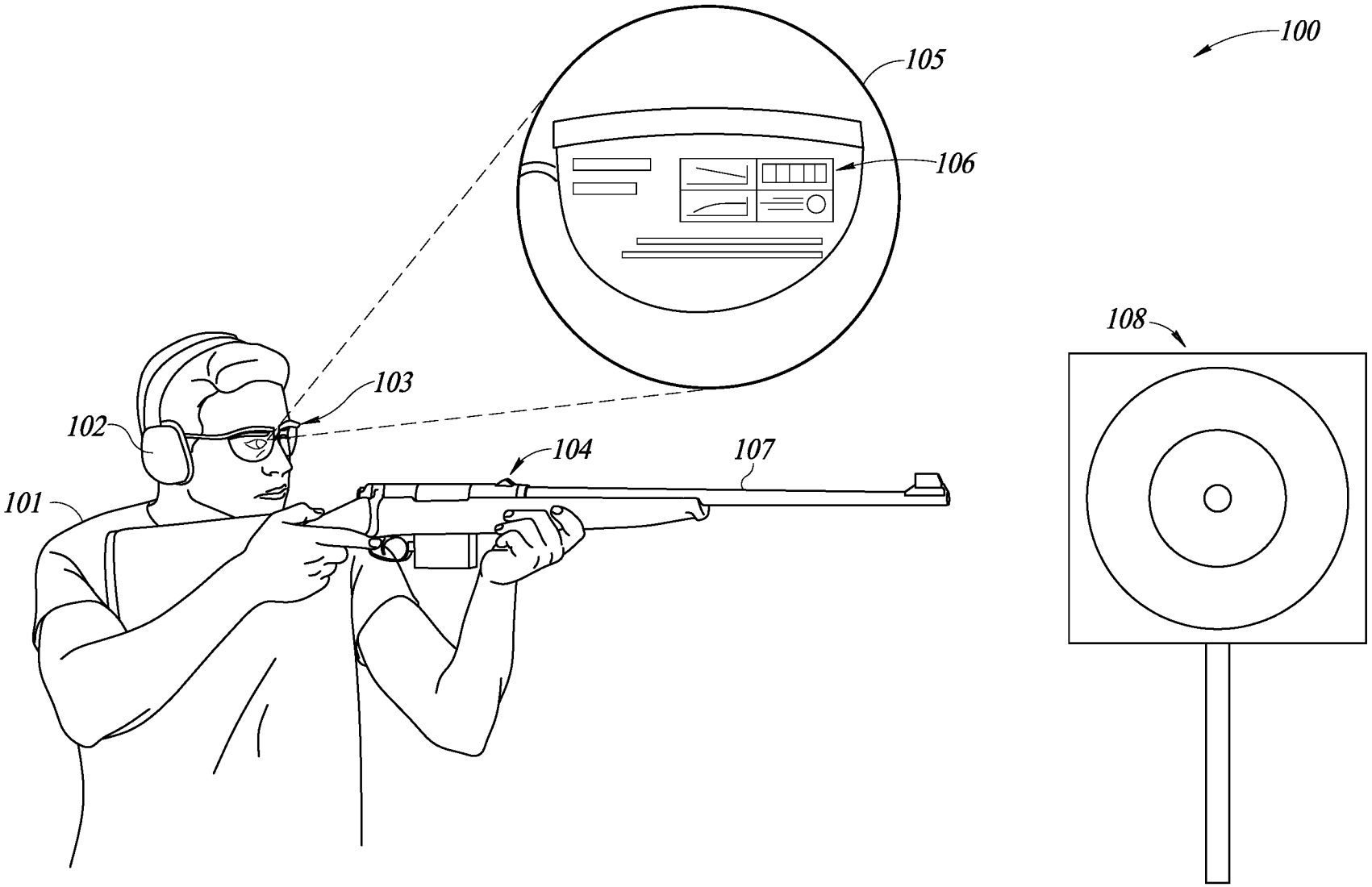
FIG. 1 illustrates a schematic diagram for adjusting aim of a projectile based, at least in part, on temperature properties of a gun barrel in accordance with at least one embodiment.

Firing (e.g., igniting) a round of a projectile may be caused by a firing pin striking a primer of a cartridge. A cartridge may comprise a casing, primer (e.g., rimfire or centerfire), powder, and a projectile (e.g., bullet, slug, and/or shot). For example, when a gun (e.g., firearm) fires (e.g., shoots) a round, a primer ignites the powder, releasing heat and gas, where pressure of the gas may cause the projectile to travel down the gun barrel. Friction and the pressure between the bullet, the casing, and the barrel may cause heat to be generated, and that heat is conducted through the gun barrel. Ignition of gun powder and hot gas moving through the gun barrel (e.g., hot gas at a high pressure) can also cause a gun barrel to heat up (e.g., increase in temperature). For example, the barrel increases in temperature because of the friction of the bullet and the pressure of the charge propelling it. The amount and frequency in which rounds of projectiles are fired may increase the temperature of the barrel.

The barrel can have different heat conductive properties based on its material of construction (e.g., carbon steel, stainless steel), the thickness of gun barrel material (e.g., 0.25 inches, 0.03 inches, 0.05 inches), the shape of the gun barrel (e.g., narrowing), the length of gun barrel (e.g., 18 inches, 10 inches, 26 inches), the rifling of the gun barrel (e.g., number of grooves, distance between grooves), and other physical properties of the gun barrel or parts coupled to the gun barrel. In at least one embodiment, rifling includes an arrangement of spiral grooves on the inside of a rifle barrel. An amount and frequency in which rounds of projectiles are fired may increase the temperature of a barrel, which may cause a barrel to become hot (e.g., 200° F., 500° F., 1000° F.), including its interior and exterior surface.

When a gun barrel is of a high temperature, it may not cool down quickly (e.g., not sufficient time between rounds fired) because air surrounding the gun is a poor heat conductor or a marksman may continue to fire subsequent rounds, such that the gun barrel keeps progressively heating up from the process of firing a projectile. Also, most gun barrels include metals, which retain heat for long periods of time (e.g., several minutes or even hours).

As an example, these barrels retaining heat at an increased temperature may impact the projectile's trajectory based, at least in part, on an increased burn rate of a charge and increased pressure of the gas in subsequent shots. When there is an increase in burn rate of a charge and increased pressure of the gas, the muzzle velocity of the round may also increase. A projectile with an increased muzzle velocity may also have a straighter trajectory, but this occurs irregularly when it is caused by barrel temperature and can be difficult to predict, as barrel temperature may change rapidly. The barrel varying in temperature (as it may decrease in temperature over time) could cause the velocity of the round to be unpredictable if the barrel is not sufficiently cooled. In some cases, firing rounds while a barrel is at a high temperature may cause damage to the barrel.

Temperature may also be distributed unevenly along the length of the barrel. An amount of pressure may change rapidly, such as once the bullet exits the barrel (e.g., releasing the pressure). The barrel may release heat out the muzzle of the barrel, causing a barrel to cool unevenly as well. The density of material along the length of the barrel, if variable, may cause uneven heating, and thus may result in an uneven distribution of temperature across the barrel's length. Environmental conditions (e.g., weather, moisture, rain, snow, time of year, and/or direct sunlight) can also impact the temperature of a barrel. Calculations to predict a projectile's drop over a distance can be challenging to calculate, as the temperature of the barrel may change over time.

In at least one embodiment, as a gun barrel heats up, thermal expansion occurs, which can alter a bore diameter and the barrel's harmonics, which can in turn affect the bullet's trajectory. In at least one embodiment, rapid firing can cause uneven heating, which can cause a barrel to warp or bend and consequently altering a point of impact of the bullets. A burn rate of the gunpowder can be sensitive to temperature changes, where a hotter barrel can cause a faster burn rate and a higher muzzle velocity, which can change the bullet's trajectory. Temperature variations can alter a level of friction between the bullet and the barrel, which can affect a bullet's velocity. High temperatures from prolonged shooting can cause wear and tear, impacting the barrel's integrity and accuracy over time. In at least one embodiment, performance of some types of ammunition may vary when fired from a hot barrel due to their sensitivity to temperature changes. In at least one embodiment, high temperatures can change the viscosity of the lubricants in a gun barrel, affecting their protective qualities.

In performing precision marksmanship, variables impacting consistency and predictability of a projectile are typically best isolated and controlled. In at least one embodiment, the disclosed technology apparatus, system, computer-readable medium, and/or process is to measure, sense, or otherwise determine temperature measurements of a gun barrel (e.g., temperature profile) and use that information to generate instructions to adjust aim of a projectile before, during, and/or after (e.g., next shot) firing the projectile.

For example, a firearm includes one or more temperature sensors within its barrel that measure the temperature profile of a barrel before and/or after it is fired (e.g., measurement for each round); and these sensors provide one or more measurements to a processor (e.g., central processing unit (CPU), graphics processing unit (GPU), application specific processing circuit (ASIC)) and the processor uses these temperature measurements to generate a temperature profile and instructions for adjusting aim of a gun when shooting based on a temperature profile. Instructions generated may include a cold bore (e.g., a zero prior to firing a round) and/or hot bore zero (e.g., a zero after firing a round) for a barrel.

In at least one embodiment, a temperature profile includes a data structure for one or more temperature measurements (e.g., to include predicted temperatures over time) and predicted barrel temperature over time. A data structure may also include predicted muzzle velocity of a round based, at least in part, on barrel temperature, such as a projectile's predicted trajectory. For example, a processor may use a data structure to predict barrel temperature over a number of rounds fired. For example, a temperature profile of a barrel can be graphically depicted for how temperature varies along the barrel, such as by showing the heat distribution over time and/or over one or more rounds fired.

In at least one embodiment, the disclosed technology apparatus, system, computer-readable medium, and/or process includes instruction to a marksman to adjust aim of a gun based on minute of angle (MOA), which correlates to the minute hand of a 360-degree clock face, where each minute refers to 1/60th of a degree, similar to the minutes of an hour. MOA may be used to calculate group size at a target some distance (e.g., yards, feet), such as 1 MOA is a 1" circle at 100 yards (e.g., 3" at 300 yards). When adjusting sights (e.g., telescopic and/or open) for a distance, the MOA may be calculated to know how many clicks (e.g., 1 click=¼ MOA) adjusting a scope are needed to move sights an inch, such as shots grouped at a distance at 100 yards would need 4 clicks to adjust 1". A process may then calculate an expected muzzle velocity for a round based, at least in part, on a temperature of a barrel (e.g., using one or more sensors) and then predict an MOA needed to adjust a group of shots for a distance (e.g., 300 yards). In at least one embodiment, an MOA adjustment corresponds to whether a firearm was sighted (e.g., zeroed) for a cold or hot bore. A user may input that a rifle is zeroed for a hot bore and then a neural network generates a cold bore MOA adjustment to the sight for a first shot based, at least in part, on sensory information of a barrel.

In at least one embodiment, a gun is fired one or more times at a manufacturing site, laboratory, in a vice (e.g., clamping device) or other controlled location such that variables (e.g., wind, gun type, gun properties, distance to target, size of target) are monitored and controlled by a manufacturer. A manufacturer can generate a temperature profile for a particular gun model (e.g., caliber of rifle, manufacturer, type of ammunition), where the gun tested in the laboratory has sensors in its gun barrel, on its gun barrel, or remotely (e.g., with a laser that tests the temperature of the gun barrel from a distance). As an example, a temperature profile may include a cold-bore (e.g., prior to the rifle being fired) MOA adjust for a first shot when zeroed for a hot-bore (e.g., after a first shot). In at least one embodiment, an application may also receive self-collected data for types of ammunition not otherwise in the temperature profile generated by a manufacturer (e.g., self-loading ammunition) and generate a temperature profile over time from the sensors. Devices, such as IR laser or camera-based shooting and training systems (e.g., Shooter's Computer-Aided Training Tool, SCATT) may collect result data of a fired round and be used in connection with generating a temperature profile for a firearm.

Example embodiments are described herein with reference to the accompanying drawings. The figures are not necessarily drawn to scale. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open-ended in that an item or items following any one of these words is not meant to be an exhaustive listing of such item or items or meant to be limited to only the listed item or items. It should also be noted that as used herein and in the appended claims, the singular forms "a," "an," and "the" include plural references unless the context clearly dictates otherwise.

In the following description, various working examples are provided for illustrative purposes. However, it is to be understood the present disclosure may be practiced without one or more of these details. Reference will now be made in detail to non-limiting examples of this disclosure, examples of which are illustrated in the accompanying drawings. The examples are described below by referring to the drawings, wherein like reference numerals refer to like elements.

When similar reference numerals are shown, corresponding description(s) are not repeated, and the interested reader is referred to the previously discussed figure(s) for a description of the like element(s).

In at least one embodiment, the disclosed technology can be used for cartridges designed for different types of projectiles, such as those fired by gun (e.g., of a particular caliber or gauge), though the disclosed technology may also be used for other guns, such as projectile cartridges for artillery. A type of gun can impact ballistics associated with firing a bullet. A gun can be any type of firearm used by an individual, such as a handgun (e.g., pistol), shotgun (e.g., slugs or shot), or rifle (semi-automatic or automatic). A gun may also include crew-served equipment to fire a projectile from a barrel, such as artillery or naval guns. In some embodiments, the disclosed technology works with guns (e.g., rifles) used for precision shooting (e.g., long range), e.g., long-rang precision rifle shooting. For example, the disclosed technology can be used with 0.22 long rifle, Blaster R8, Remington Model 770, CMMG MK47 Mutant, Colt C-19, Bergara B-14 BMP, Savage Model 10 GRS, Howa HCR, Proof Glacier Ti, Accuracy International AXSR, Seekins Havak Pro Hunter 2, Mauser M18, Sako TRG 22 A1, Mossberg Patriot LR Tactical, Accuracy International AT-X, Tikka T3X UPR, Seekins Havak HIT, Christensen Arms MPR, Daniel Defense Delta 5, and/or other long-range rifle for precision shooting. In at least one embodiment, the disclosed technology uses or otherwise includes ammunition such .223 Remington, 5.5 NATO, .224 Valkyrie, 6.5 Grendel, 6 mm Creedmoor, 6.5 Creedmoor, .308 Winchester, self-loaded cartridges, or other cartridges used with long-range rifles. Temperature profiles to predict a projectile's trajectory over a distance may be generated by a type of gun, the cartridge used (e.g., an amount of powder and/or size of projectile), and/or the manufacturer. Instructions to a marksman may also include a preferred temperature for firing at a distance, recommend a time period to expire until a subsequent shot, and/or indicate when a cool-off time period has expired.

FIG. 1 illustrates a schematic diagram for adjusting the aim of a projectile based, at least in part, on temperature properties of a gun barrel in accordance with at least one embodiment. FIG. 1 includes a shooting environment 100 and a marksman 101 aiming a gun 102 barrel 107 at a target 108. FIG. 1 also includes marksman 101 wearing glasses 103 that can display information 104 on a lens as shown by graphical user interface 105.

A marksman aiming a projectile may need to take many factors into consideration and as distance increases between a marksman 101 and a desired target 108, these factors may impact the result more significantly. For example, a group of shots may be 1" in diameter at 100 yards and 3" in diameter at 300 yards when introducing the same amount of movement of the marksman, holding other factors constant. Marksmen, when training to fire a projectile, may often find a dilemma of whether it is their equipment (e.g., projectile weight, cartridge to include projectile size and/or amount of charge, rifle design, trigger mechanics, sight), environmental conditions (e.g., wind, moisture, correct distance calculations attributing for altitude, and/or temperature) and/or biometrics (e.g., muscle fatigue, heart rate, shot approach, and/or breathing). As these variables can be exacerbated over longer distances, controlling (e.g., isolating) a variable can improve performance and/or affirm that performance is being consistent. In at least one embodiment, glasses 103 may display information to include biometrics, environmental conditions, and/or equipment information (e.g., temperature measurements, image of target, prior outcomes) shown by a graphical user interface 105, such as to predict a desired aim for a target (e.g., MOA needed to adjust sights to aim directly through sight).

The information 104 can include instructions for aiming a gun based on temperature measurements of a gun barrel, predicted temperature measurements of a gun barrel, or previous temperature measurements of a gun barrel after shooting. For example, information 104 can include information for adjusting sight alignment, location of the gun barrel, location of the gun, and/or instructions for positioning a gun or sights (e.g., MOA and/or sight clicks) a particular amount. A system, processor, or other means disclosed in FIGS. 2A-7 can generate information 104. In at least one embodiment, headphones 106 (e.g., sound canceling ear protection with audio) can generate audio instructions with information 104 such that a marksman can hear instructions for aiming.

In at least one embodiment, a system provides instructions using information 104 to modify the aim of a barrel based, at least in part, on the barrel's temperature. This provided modification may occur live, when invoked (e.g., user initiated, such as by pressing a button), between one or more shots, and/or between a series of shots. Identifying the aim, such that user instructions of an adjustment may be provided, may occur using one or more of the described methods. A first method may include identifying the aim of a barrel, which may occur through a sensor attached to the end of the barrel and a sensor on the desired target, such that a trajectory is measured. This may provide for live updates and recommended adjustments. A second method may include identifying a target and/or your position through a global positioning system (GPS), then uploading (e.g., manually through an image of the target and/or a sensor and/or laser returning results of each shot to a device) results to an application, such that instructions are available between each shot or series of shots. A third method may include selecting through a mapping system (e.g., GPS) the location of yourself and the target. A fourth method may include using a range finder in combination with returned results from a target (e.g., manual upload through image and/or sensors determining shot location). A fifth method may include a set of glasses with a range finder, where a user may invoke (e.g., through pushing a button, such as on the frame of the glasses) a target with a sensor being at a set location, then based, at least in part, on previous results, it may return instructions for subsequent shots. Methods described may then apply physics equations such as physics trajectory based, at least in part, on the target result and position of the marksman. Using this trajectory and manufacturer information from a result, information pertaining to the trajectory and velocity can be calculated. Methods described may be used in combination with laser target systems (e.g., SCATT). Furthermore, an option may include, when a rifle includes a dry firing option that would not damage the gun, to simulate firing a shot.

Figure 2A:
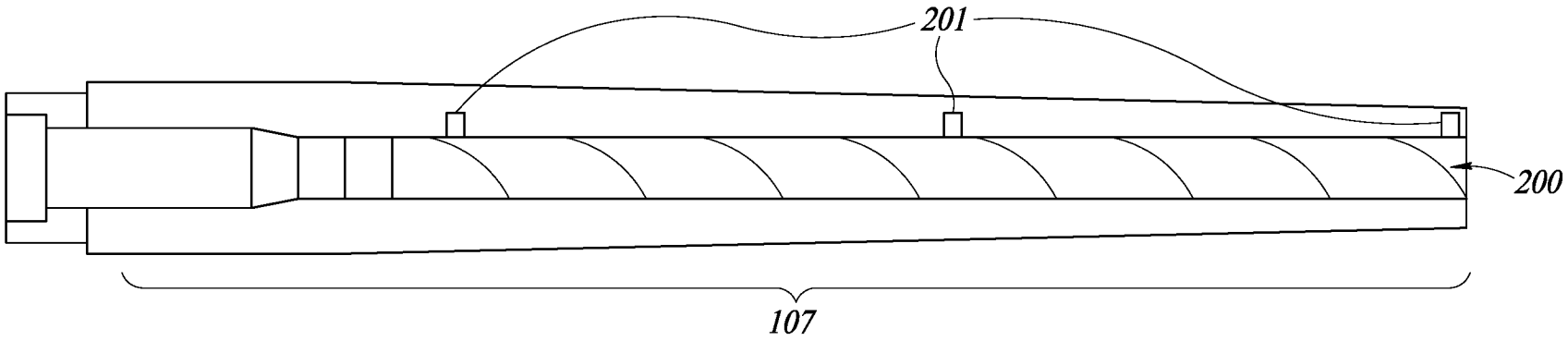
FIGS. 2A and 2B illustrate a barrel including one or more sensors in accordance with at least one embodiment.
Figure 2B:
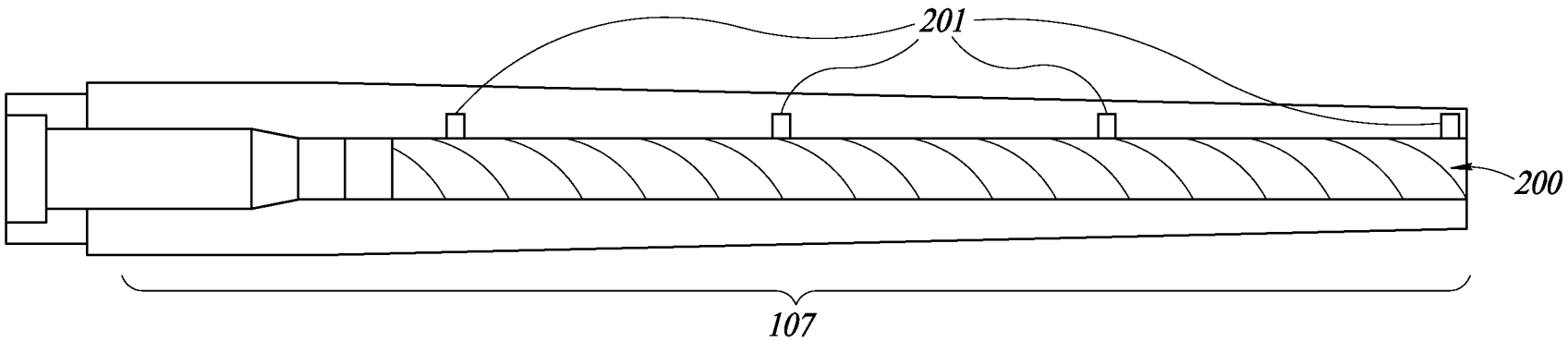

FIGS. 2A and 2B illustrate a barrel including one or more sensors in accordance with at least one embodiment. FIGS. 2A and 2B include a more detailed view of gun 102 from FIG. 1. FIGS. 2A and 2B illustrate sensors 201, which are located at different positions along gun barrel 107. FIGS. 2A and 2B illustrate that gun 102 may include rifling. FIG. 2A illustrates gun barrel 107 with more rifling than rifling in FIG. 2B. FIG. 2A illustrates gun 102 with three sensors, and FIG. 2B illustrates gun 102 with four sensors.

Sensor 201 may be a temperature sensor. For example, sensor 201 can be a negative temperature coefficient (NTC)

thermistor, resistance temperature detector (RTDs), thermocouple, semiconductor-based temperature sensor, or any combination thereof. A thermistor can be a thermally sensitive resistor that exhibits a continuous, small, incremental change in resistance correlated to variations in temperature, e.g., an NTC thermistor provides higher resistance at low temperatures. As temperature increases, the resistance drops incrementally, according to its R-T table such that small changes reflect accurately due to large changes in resistance per ° F. or C. In at least one embodiment, a resistance temperature detector, or RTD, changes the resistance of the RTD element with temperature. For example, an RTD can include film or, for greater accuracy, a wire wrapped around a ceramic or glass core. In at least one embodiment, a thermocouple includes two wires of different metals electrically bonded at two points. For example, varying voltage created between these two dissimilar metals reflects proportional changes in temperature. In at least one embodiment, a semiconductor-based temperature sensor can be incorporated into integrated circuits (ICs) and utilize two identical diodes with temperature-sensitive voltage versus current characteristics that are used to monitor changes in temperature.

In at least one embodiment, sensors 201 are integrated into gun barrel and transmit measurements wireless (e.g., Bluetooth, ZigBee, Wi-Fi, Radio Frequency Identification (RFID)). In another embodiment, sensors 201 are attached to a gun barrel or inserted into a groove of a gun barrel. A gun manufacturer can include one or more (e.g., 1, 10, 50, 100) sensors in a gun barrel when generating temperature measurements. For example, before selling a gun, a gun manufacturer can fire the gun several times with the temperatures sensors to determine how the gun barrel warms up and cools down. The gun manufacturer can then provide this temperature information as part of selling the gun (e.g., in a mobile application, instructions, or for download) for one or more cartridges. In at least one embodiment, sensors may report active sensor measurements while aiming a barrel and a marksman may measure temperature readings of a barrel when using one or more types of ammunition (e.g., testing ammunition). In at least one embodiment, a neural network predicts a muzzle velocity of a cartridge and/or trajectory of a projectile based, at least in part, on a temperature of a barrel.

Figure 3:
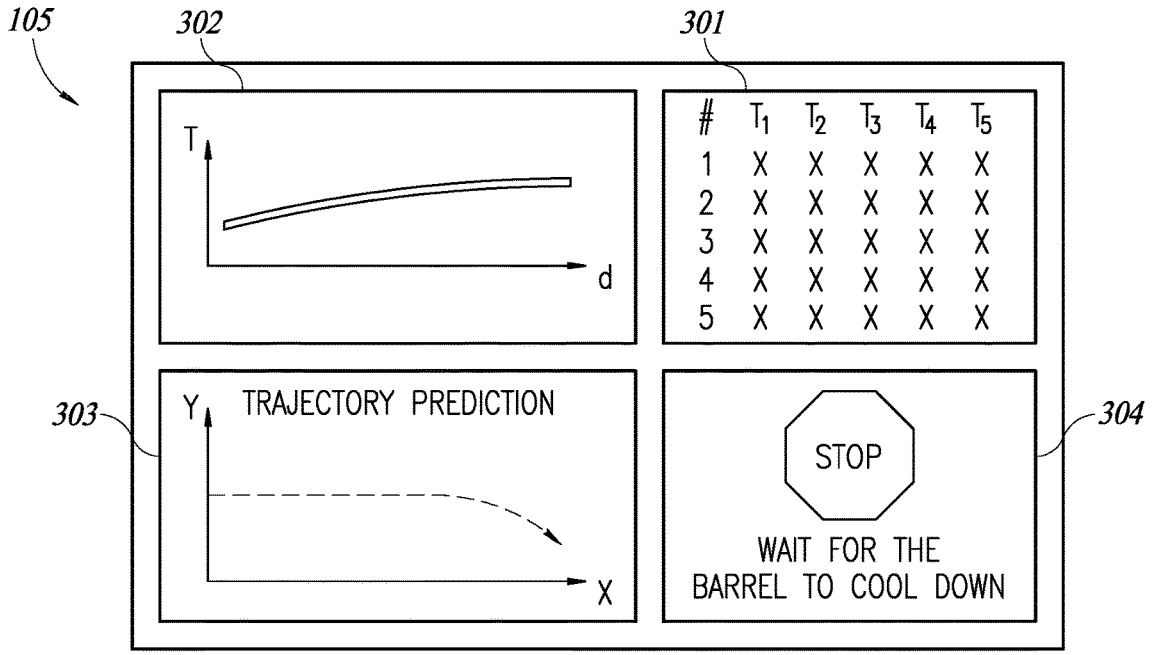
FIG. 3 illustrates a graphical user interface for providing information to a user in accordance with at least one embodiment.

FIG. 3 illustrates a graphical user interface 105 for providing information to a user in accordance with at least one embodiment. A computing device such as computing device 404 in FIG. 4, glasses with a processor, or other computing device can generate graphical user interface 105. A device can display graphical user interface 105 on a screen, on lens of glasses, or another visible user interface. Graphical user interface 105 can be integrated into shooting environment 100 in FIG. 1 to help a marksman adjust aiming using a gun barrel such as gun barrel 107 in FIGS. 2A and 2B. A device performing or using process 505 (FIG. 5) and/or process 600 (FIG. 6) can display or generate graphical user interface 105. Graphical user interface may acquire a distance (e.g., yardage) of a target by user input, GPS, Bluetooth, and/or a laser (e.g., range finder). Graphical user interface 105 can display one message at a time (e.g., "MOA is 3 inches for 300 yards," "aim lower by ½ inch," or "aim lower 1 minute of angle").

In the upper left 302 of graphical user interface 105, a graph illustrates how changes in temperature can change a trajectory of a projectile, such as a flatter trajectory as temperatures increase. For example, if a gun is fired several times, its gun barrel will heat up and may increase muzzle velocity of a projectile, such as through increased pressure with the temperature and/or charge lighting at a faster rate. However, as the barrel cools, this trajectory may then start to have a steeper curve in trajectory. Temperature readings across a barrel can help predict the trajectory of a projectile over time. Note, that temperature can affect a gun barrel in different ways and gun barrels have different shapes, sizes, and materials of construction such that the graphical user interface 105 may change based on gun barrel properties.

In the upper right 301 of graphical user interface 105, a table illustrates how many times a gun is fired, and the measured temperature of the gun barrel at different locations (e.g., front of barrel is T1, middle points of barrel is T2-T4, and opposite end of front of barrel has temperature T5). For example:

| Number of Shots | Temperature: Sensor 1 | Sensor 2 | Sensor 3 | Average Temperature | Adjustment in Inches |
|---|---|---|---|---|---|
| 0 | 70 | 70 | 70 | 70 | (Zero) |
| 1 | 72 | 73 | 74 | 73 | −.1 |
| 2 | 80 | 82 | 84 | 82 | −.3 |
| . . . | | | | | |
| 60 | 180 | 190 | 200 | 190 | (Stop) wait until return to 150 F., t = 1 min.) |

The information displayed in the upper right of graphical user interface 105 can be used by a marksman to adjust their aim. For example, a marksman may observe that for shots 1-5, the temperature of the front gun barrel (e.g., closed to the chamber) is increased, but the temperature of the rest of the barrel is only gradually increasing (e.g., by a few degrees). As another example, a marksman may observe that for shots 1-3 that the temperature of the gun barrel is rapidly increasing (e.g., 20, 40, or even 100 degrees per shot), and a marksman may use this information to adjust their aim. A marksman (e.g., shooter) may also receive temperature readings with a warning to not fire additional rounds for a period of time, such as to not damage their barrel and allow the barrel to cool.

In the bottom left 303 of FIG. 3, graphical user interface 105 displays a predicted trajectory of a bullet based, at least in part, on distance and temperature measurements of the barrel. For example, if a barrel is warm (e.g., 100 degrees Fahrenheit higher than earlier), the graphical user interface may indicate that the bullet will travel a straighter trajectory over a distance. As another example, if a gun barrel is cold or cooling (e.g., no shots have been fired and the ambient temperature is low), the trajectory may indicate that the trajectory will have a greater drop (e.g., steeper trajectory) than a previous shot.

In bottom right of FIG. 3, graphical user interface 105 includes instructions for a marksman. For example, a non-transitory computer-readable medium, includes instructions (e.g. instructions used by graphical user interface 105) which when executed by the one or more processors, further cause the one or more processors to: identify a number of times a barrel has been used to fire a projectile; identify an amount of time that has elapsed between each shot; and modify the adjustment to modify the aim based on the identified number of times the barrel has been used to fire a projectile and the amount of time that has elapsed between each shot and/or otherwise perform operations described herein.

Specifically, a device such as computer device 404 generates a graphical user interface 105 which may indicate a marksman should stop shooting, such as when trajectory cannot be computed from temperature readings, barrel is of a temperature where it could be damaged, and/or allow to cool for a period of time for a desired trajectory (e.g., to prevent additional sight adjustments or approximating aim to account for windage). For example, graphical user interface 105 may display information and/or instructions based, at least in part, on equipment information (e.g., cartridge to include projectile size and/or amount of charge, rifle design, trigger mechanics, sight), environmental conditions (e.g., wind, moisture, correct distance calculations attributing for altitude, and/or temperature) and/or biometrics (e.g., muscle fatigue, heart rate, shot approach, and/or breathing), such as to predict a desired aim for a target (e.g., MOA needed to adjust sights to aim directly through sight).

Figure 4:
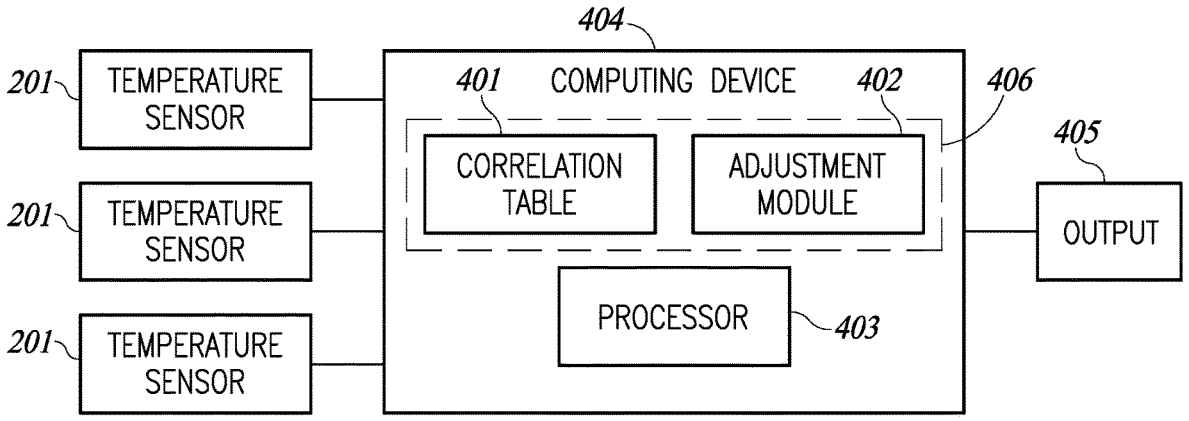
FIG. 4 illustrates a schematic block diagram including a system for adjusting a marksman's aim when firing a projectile round in accordance with at least one embodiment.

FIG. 4 illustrates a schematic block diagram including a system for adjusting a marksman's aim when firing a projectile round in accordance with at least one embodiment. FIG. 4 includes temperatures sensors 201 (such as those illustrated in FIG. 2) and computing device 404, which can generate an output 405 (e.g., instructions for a marksman, warnings for a marksman, temperature profiles). Computing device 404 can include a correlation table 401, an adjustment module 402, and a processor 403. Processor 403 can receive measurements from temperature sensors 201 and use correlation table 401 and/or adjustment module 402 to generate instructions for a marksman. As shown by dashed line 406, the correlation table 401 and adjustment module 402 can be combined into a single software module, logic, or combination thereof.

Correlation table 401 is software which when performed by a processor can correlate temperature and aim values. For example, a correlation table 401 can include information about a gun barrel (e.g., length, metal of composition, identity of manufacturer, width of gun barrel, rifling of gun barrel) and temperature information (e.g., temperature measurements and location of measurements). Correlation table may also include their equipment information (e.g., cartridge to include projectile size and/or amount of charge, rifle design, trigger mechanics, sight), environmental conditions (e.g., wind, moisture, correct distance calculations attributing for altitude, and/or temperature) and/or biometrics (e.g., muscle fatigue prediction, desired time while aiming, position to fire from, heart rate, shot approach, and/or breathing).

Adjustment module 402 is software, which when performed by a processor can generate instructions such as for making an adjustment to a gun based on temperature measurements. Adjustment module 402 can include a neural network that receives temperature readings, gun type, barrel properties, projectile information, and/or other conditions (e.g., environmental, biometric, and/or equipment information) for aiming and firing a gun, then outputs a suggested aim adjustment (e.g., a predicted MOA). Adjustment module 402 can determine where a marksman is currently aiming (e.g., based on location of gun, video of person shooting the gun, crosshairs of gun, motion detectors on gun, laser sensors at target and laser on gun) and generate instructions for adjusting aim. For example, adjustment module 402 may be used in connection with an IR laser or camera-based shooting training system (e.g., SCATT).

Processor 403 can execute computer-executable instructions, non-transitory computer-readable instructions, or machine-readable instructions. Processor 403 can constitute any physical device or group of devices having electric circuitry that performs a logic operation on an input or inputs. For example, processor 403 can include one or more integrated circuits (IC), including application-specific integrated circuit (ASIC), microchips, microcontrollers, microprocessors, all or part of a central processing unit (CPU), graphics processing unit (GPU), digital signal processor (DSP), field-programmable gate array (FPGA), server, virtual server, or other circuits suitable for executing instructions or performing logic operations. The instructions executed by processor 403, for example, may be pre-loaded into a memory integrated with or embedded into the controller or may be stored in a separate memory. Processor 403 can be separate circuits or integrated in a single circuit. Processor 403 can be configured to operate independently or collaboratively. Processor 403 can be coupled electrically, magnetically, optically, acoustically, mechanically, or by other means that permit it to interact with computer device 404 or other processing units. In at least one embodiment, processor 403 can use application programming interfaces (APIs) to perform operations or receive information related to ballistics (e.g., gun barrel information, temperature barrel information, correlation information).

Processor 403 can access, use, or otherwise communicate with volatile memory (e.g., registers, cache, RAM), non-volatile memory (e.g., ROM, EEPROM, flash memory), or some combination of the two. Memory can store software (e.g., correlation table 401, adjustment module 402) for implementing one or more of the described embodiments. For example, memory may store correlation table 401, adjustment module 402 for implementing any of the disclosed techniques described herein and their accompanying user interfaces. Memory can include any mechanism for storing electronic data or instructions, including Random Access Memory (RAM), a Read-Only Memory (ROM), a hard disk, an optical disk, a magnetic medium, a flash memory, other permanent, fixed, volatile, or non-volatile memory. Memory can include one or more separate storage devices collocated or disbursed, capable of storing data structures, instructions, or any other data. Memory can further include a memory portion containing instructions for the processor to execute. Memory can may also be used as a working memory device for the processors or as a temporary storage.

In some embodiments, memory can be a non-transitory computer readable medium containing instructions that when executed by at least one processing unit (e.g., processor 403) cause a computing environment to perform a method or set of operations. Non-transitory computer readable mediums may be any medium capable of storing data in any memory in a way that may be read by any computing device with a processor to carry out methods or any other instructions stored in the memory. The non-transitory computer readable medium may be implemented to include any combination of software, firmware, and hardware. Software may preferably be implemented as an application program tangibly embodied on a program storage unit or computer readable medium consisting of parts, or of certain devices or a combination of devices. The application program may be uploaded to and executed by a machine comprising any suitable architecture. In at least one embodiment, a non-transitory computer readable medium includes a software program that includes instructions to perform operations that cause a computer or process to generate control signals or perform operations.

Figure 5:
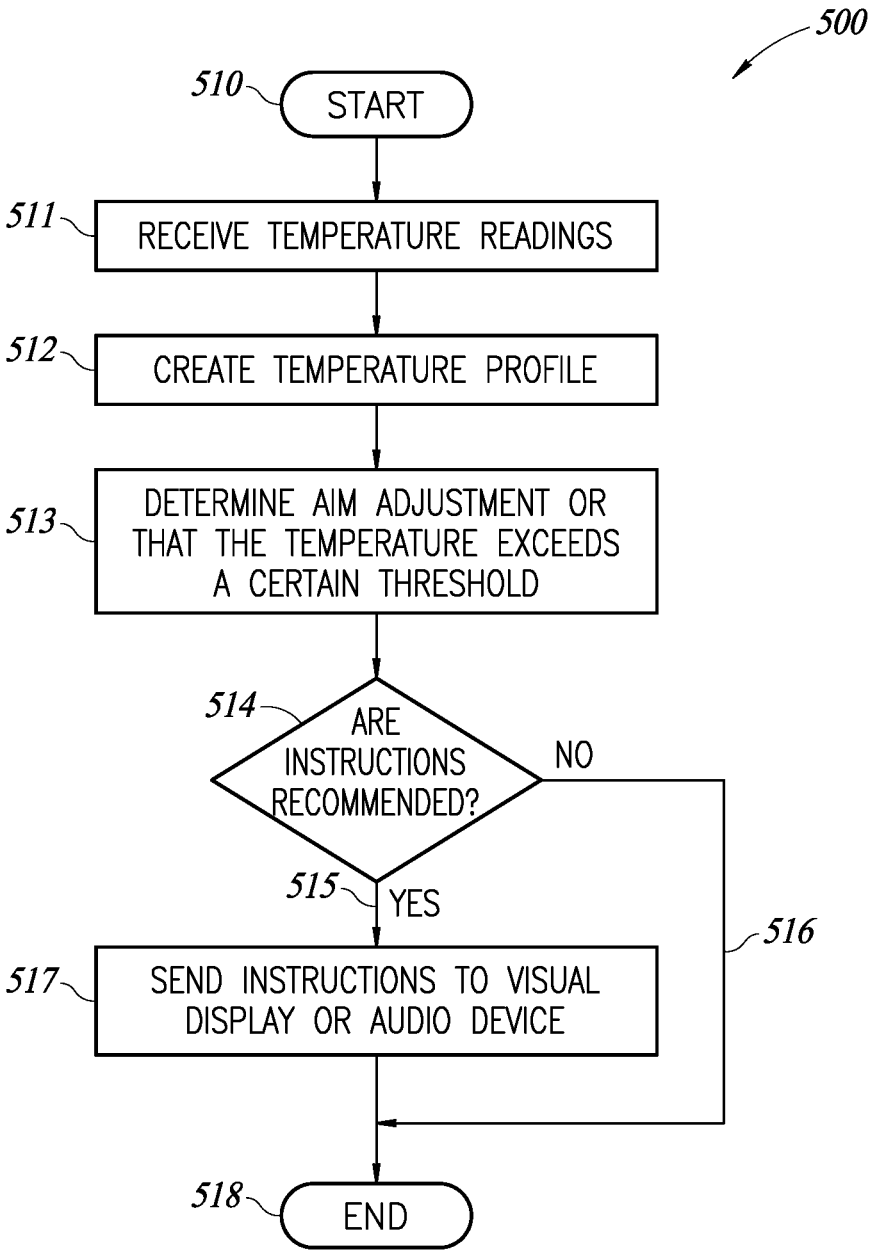
FIG. 5 illustrates a process flow diagram of process for a marksman adjusting aim of a projectile based, at least in part, on temperature properties in accordance with at least one embodiment.

FIG. 5 illustrates a process flow diagram of process 500 for a marksman adjusting aim of a projectile based, at least in part, on temperature properties in accordance with at least one embodiment. Computer, system, processor, or combination thereof can perform process 500 to generate instructions for a marksman that indicate how to modify the aim of the gun based on the temperature measurement. A computer, person, marksman, or operation can start process 500 at start step 510 (e.g., by turning on a computer, opening up a mobile application that assists users in aiming their gun). For example, instructions may be generated by calculating a predicted muzzle velocity and/or bullet trajectory based, at least in part, on temperature and a ballistic coefficient (e.g., a projectile's resistance to drag).

At operation 511, a computing device receives temperature readings. For example, a gun includes several (e.g., 4, 5) temperature sensors within its barrel that measure the temperature profile of a gun barrel after it is fired (e.g., each time it is shot or after several shots); and these sensors provide their measurements to a processor (e.g., CPU, GPU, ASIC, FPGA). For example, a mobile phone performing a mobile application (also referred to as an "app") can receive temperature readings from several sensors on a gun barrel when it is being shot. As another example, a manufacturer fires a gun at a manufacturing site, in a laboratory, and/or other controlled location such that variables (e.g., wind, gun type, gun properties, distance to target, size of target) are calculated (e.g., to construct a rifle temperature profile).

At operation 512, a computing device and the processor use these temperature measurements to generate a temperature profile and instructions for adjusting aim of a gun when shooting based on a temperature profile.

At operation 513, a computing device determines aim adjustment or that the temperature exceeds a certain threshold. For example, a computing device receives the temperature measurements from gun barrel and determines if these temperature measurements exceed a minimum temperature such that a bullet's trajectory will be impacted by increases in temperature (e.g., 300° F.). As another example, a temperature threshold may indicate barrel will undergo cooling at a fast rate and firing of a projectile should delay until temperature stabilizes.

At decision operation 514, a computing device determines whether to generate recommended instructions for adjusting aim of the gun. For example, a computing device can determine that a gun has not been fired yet (e.g., first shot) and temperature effects on the gun barrel will be minimal (e.g., operating at a constant temperature prior to first shot) or have no effect (e.g., when a user turns on a mobile application and indicates that it is his first shot). However, a computing device may also have a set temperature at which sighting of a rifle occurred, such that any deviations to that temperature (e.g., even if prior to a first shot) will indicate to generate instructions to account for the temperature differing from when rifle last was sighted. If a computing device determines that it is a first shot and/or no instructions are recommended (e.g., barrel is at a preferred temperature), a computing device can continue to provide information (e.g., or generate additional instructions) using environmental conditions (e.g., wind, moisture, correct distance calculations attributing for altitude, and/or temperature) and/or biometrics (e.g., muscle fatigue, heart rate, shot approach, and/or breathing) as shown by 516. If a computing device determines that instructions are recommended (e.g., gun has been fired several times, temperature of gun barrel is above a threshold temperature), a computing device can generate instructions to provide to shooter as shown by 515.

At send instructions operation 517, a computing device and/or other device can send instructions to a visual display or audio device. For example, a mobile phone can send instructions to user's headphones that indicate how a user should adjust their aim based on the temperature of the gun barrel. As another example, a mobile phone displays instructions on its user interface that indicate how a marksman should adjust their aim. As another example, as shown in FIG. 1, glasses can display information for a marksman to indicate how a user should adjust their aim and/or wait a certain period of time before shooting (to allow a gun barrel to cool down). In at least one embodiment, glasses serve as eye protection.

After operation 517, process 500 can end at operation 518. In at least one embodiment, process 500 can be repeated, partially repeated, or modified. For example, process 500 can be repeated for a different gun, a different shot (e.g., shot 10 after shooting 9 times), a different time of day, after a marksman has waited a certain period of time (e.g., 1 hour) for a barrel to cool down, or at a different manufacturing location by a manufacturer to generate a new temperature profile for a gun barrel.

Figure 6:
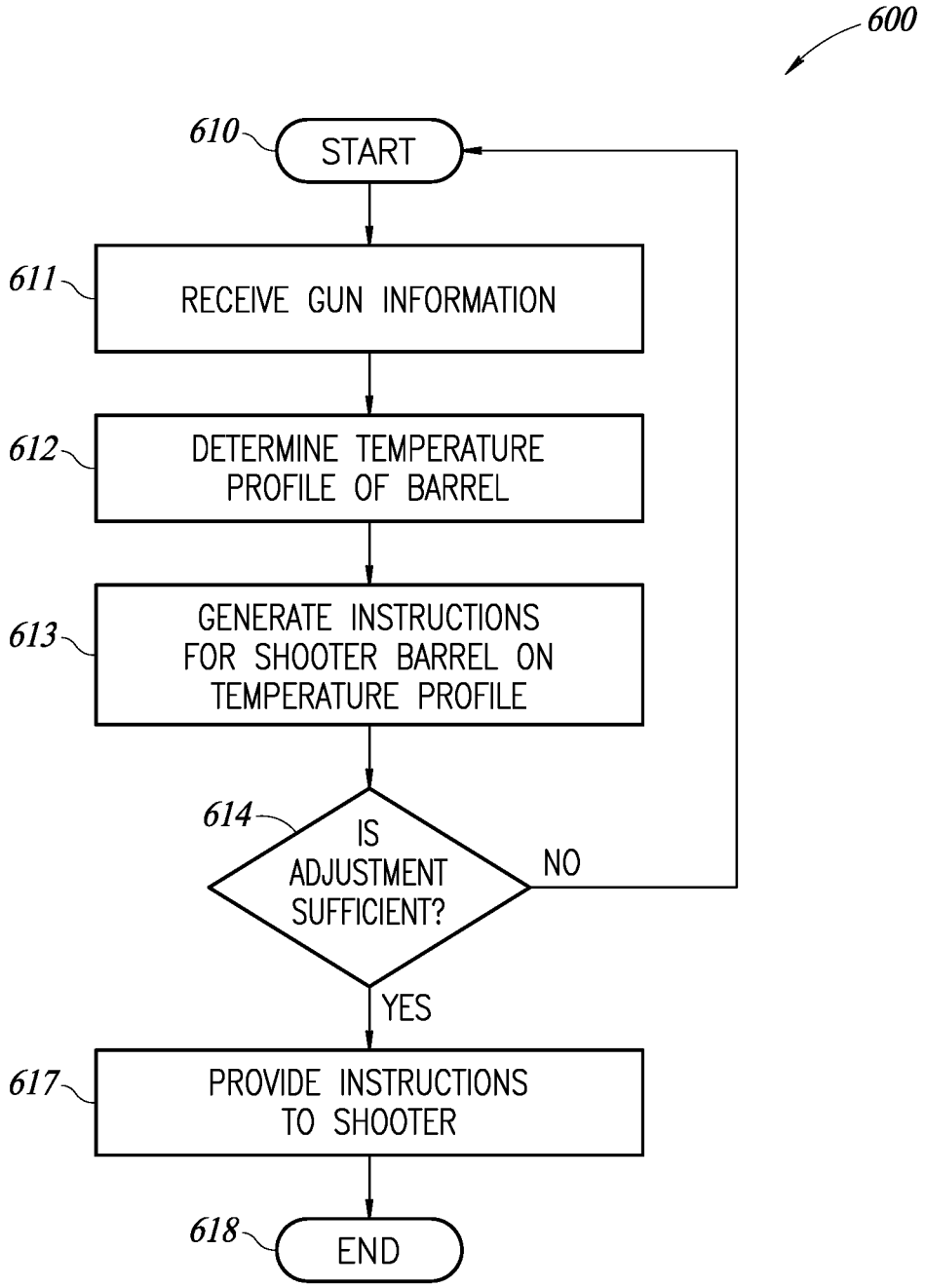
FIG. 6 illustrates another process flow diagram for a marksman adjusting aim of a projectile based, at least in part, on temperature properties of a barrel in accordance with at least one embodiment.

FIG. 6 illustrates another process flow diagram for a marksman adjusting aim of a projectile based, at least in part, on temperature properties of a barrel in accordance with at least one embodiment. Computer, system, processor, or combination thereof can perform process 600 to generate instructions for a marksman that indicate how to modify the aim of the gun based, at least in part, on the temperature measurement. In at least one embodiment, a neural network uses generated instructions for a marksman to output an audio recording of the instructions to said marksman. For example, instructions are that given "1 MOA is 3 inches at 300 yards and a click is ¼ MOA," a marksman should "click sights upwards 12 clicks to adjust sights 6 inches upwards for 300 yards," and this could be provided as audio to ear protection. A computer, person, marksman, or operation can start process 600 at start step 610 (e.g., by turning on a computer, opening up a mobile application that assists users in aiming their gun).

At operation 611, a computing device can receive gun barrel information or shooting inputs. A computing device (e.g., computing device 404 from FIG. 4) can receive a model number, gun barrel material, gun manufacturer information, a temperature reading from another device (e.g., laser temperature sensor), equipment information (e.g., cartridge to include projectile size and/or amount of charge, rifle design, trigger mechanics, sight), environmental conditions (e.g., wind, moisture, correct distance calculations attributing for altitude, and/or temperature) and/or biometrics (e.g., muscle fatigue, heart rate, shot approach, and/or breathing).

At operation 612, a computing device can determine temperature profile of a barrel. For example at operation 612, a computing device retrieves from memory a manufacturer generated profile and/or uses a neural network to generate a barrel profile. In at least one embodiment, a marksman may use self-loaded ammunition or that which a manufacturer did not create a profile on, indicating to a computing device to progressively update a barrel profile specific to the ammunition.

At operation 613, a computing device generates instructions for shooter barrel on temperature profile. As an example, the generated instructions are based, at least in part, on a temperature profile of a barrel and/or additional information. Additional information may include previous fired projectile outcomes, equipment information (e.g., cartridge to include projectile size and/or amount of charge, rifle design, trigger mechanics, sight), environmental conditions (e.g., wind, moisture, correct distance calculations attributing for altitude, and/or temperature) and/or biometrics (e.g., muscle fatigue, heart rate, shot approach, and/or breathing).

At decision operation 614, a decision is "NO," if a computing device, marksman, and/or software determines an adjustment (e.g., to sights) does not sufficiently align with a desired target, such as the barrel needs additional time to cool, sights were adjusted incorrectly, and/or environmental conditions changed. A processor determines using a sensor and/or a camera to visually determine (e.g., looking through sight and/or a number of adjustments made to sight by MOA) whether sights were aligned. A processor may use a sensor and send information to a computing device. If a decision is "YES," a computing device proceeds to operation 617.

At operation 617, a computing device provides instructions to a shooter. For example, instructions may be based, at least in part, on a predicted trajectory using temperature readings of one or more sensors. For example, a temperature reading is used to predict pressure on a projectile and thus calculate a muzzle velocity as it exits the barrel. From there a predicted trajectory may be based, at least in part, on prior projectile outcomes (e.g., results on a target), equipment information (e.g., cartridge to include projectile size and/or amount of charge, rifle design, trigger mechanics, sight), environmental conditions (e.g., wind, moisture, correct distance calculations attributing for altitude, and/or temperature) and/or biometrics (e.g., muscle fatigue, heart rate, shot approach, and/or breathing). Using a prediction, a computing device may then provide instructions, such as how to aim a projectile, an adjustment for sights, and/or time to wait until barrel is of a preferred temperature (e.g., temperature barrel was sighted in at).

After operation 617, process 600 can end at operation 618. In at least one embodiment, process 600 can be repeated, partially repeated, or modified. For example, process 600 can be repeated for a different gun, a different shot (e.g., shot 10 after shooting 9 times), a different time of day, after a marksman has waited a certain period of time (e.g., 1 hour) for a barrel to cool down, different manufacturing location by a manufacturer to generate a new temperature profile for a gun barrel, different equipment conditions (e.g., cartridge to include projectile size and/or amount of charge, rifle design, trigger mechanics, sight), different environmental conditions (e.g., wind, moisture, correct distance calculations attributing for altitude, and/or temperature) and/or different biometrics (e.g., muscle fatigue, heart rate, shot approach, and/or breathing).

Figure 7:
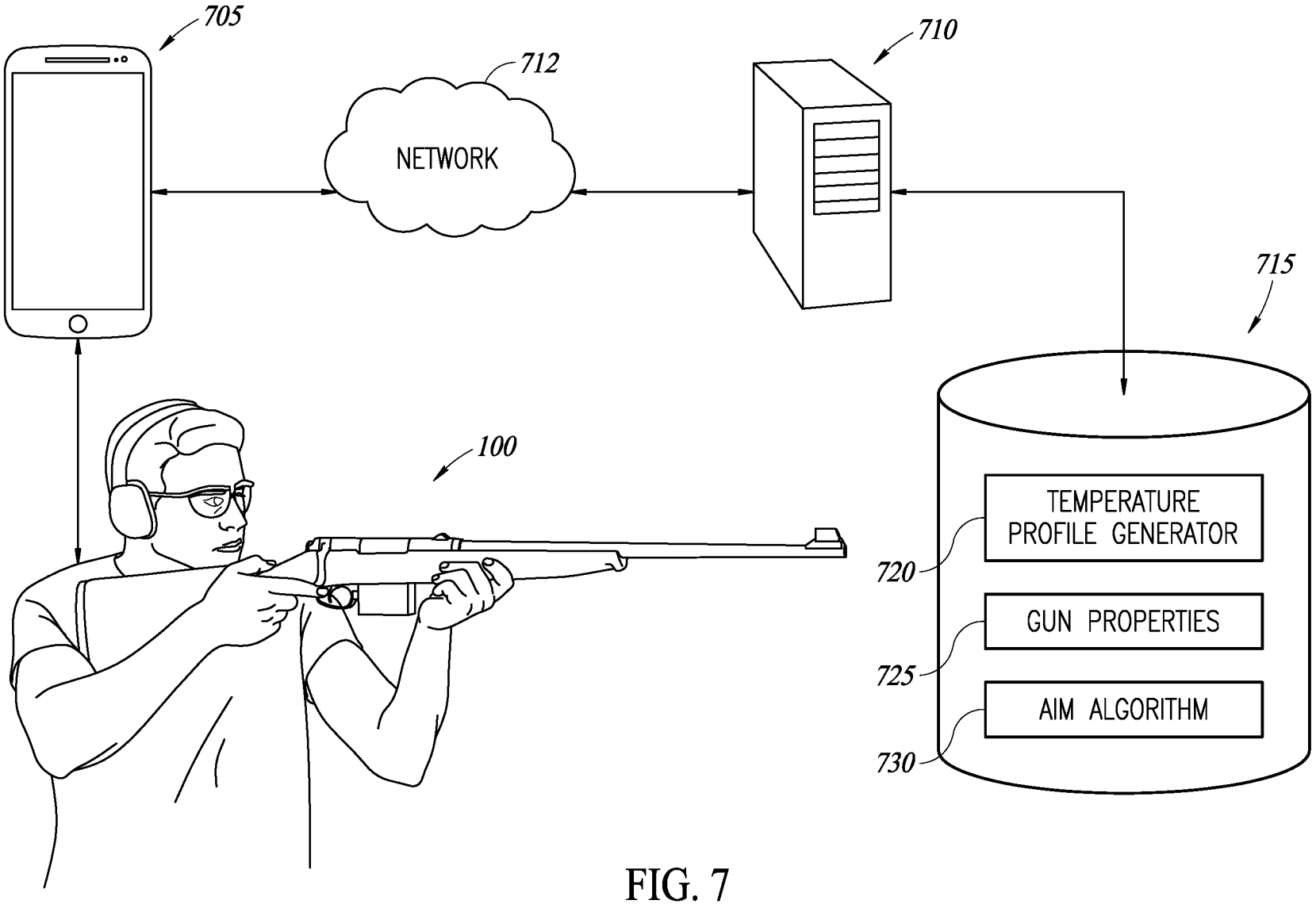
FIG. 7 illustrates a schematic block diagram including a system for adjusting aim of a projectile based, at least in part, on temperature measurements of the barrel in accordance with at least one embodiment.

FIG. 7 illustrates a schematic block diagram including a system for adjusting aim of a projectile based, at least in part, on temperature measurements of the barrel in accordance with at least one embodiment. FIG. 7 can be included in FIGS. 1-6, e.g., components in FIG. 7 can perform processes 500 and 600 disclosed in FIGS. 5 and 6, respectively. FIG. 7 can include software and hardware disclosed in FIGS. 1-4, e.g., computing device 404 can be mobile computing device 705.

FIG. 7 includes including components and objects from shooting environment 100. FIG. 7 also includes mobile computing device 705, network 712, server 710, and database 715. In at least one embodiment, a marksman from shooting environment 100 can connect to their mobile computing device 705 to receive information about how to adjust their aim of gun based, at least in part, on the temperature of a barrel.

Database 715 includes software for performing operations. Database 715 can be accessible over a network 712. Network 712 can be wireless communication network such as a Wi-Fi network, a network that follows Institute of Electrical and Electronics Engineers (IEEE) 802.11 standards for wireless communication, or a 3rd Generation Partnership Project (3GPP) standard such $3^{rd}$ generation (3G), $4^{th}$ generation (4G), $5^{th}$ generation (5G), or sixth generation (6G). In at least one embodiment database 715 includes training data for training neural networks. For example, database 715 can include labeled data of gun barrel with temperature measurements and results of firing a gun (e.g., where it hit the target, where it was aiming, muzzle velocity, and environmental conditions such as wind, temperature, weather, location). In at least one embodiment, temperature profile generator 720, gun properties 725, and aim algorithm 730 are a combination of neural networks. A neural network can include a convolution neural network (e.g., receives temperature readings as inputs and outputs instructions for adjusting aim based on input), a diffusion network, recurrent neural network, a long short-term memory network, a gated recurrent unit network, an autoencoder, a generative adversarial network, transform network, or a combination thereof. For example, input such as barrel temperature, gun type, shooter information, environmental conditions, number of shots, and time between shots can be provided to neural networks temperature profile generator 720, gun properties 725, and aim algorithm 730, and these neural networks can output instructions for adjusting aim of a gun.

Temperature profile generator 720 can include software, software modules, and/or logic that a processor (e.g., processor 403 from FIG. 4) can perform, use, and/or otherwise implement. Temperature profile generator 720 may be a neural network to generate a data structure and/or table. Temperature profile generator 720 is software, models, modules, and/or logic of a system, which a processor may perform. Temperature profile generator 720 may generate a profile for a barrel based, at least in part, on a number and/or frequency of rounds fired, equipment information (e.g., cartridge to include projectile size and/or amount of charge, manufacturer, rifle design) and/or environmental conditions (e.g., wind, moisture, correct distance calculations attributing for altitude, and/or temperature). For example, a temperature profile generator may predict muzzle velocity (e.g., velocity of a round as it leaves the barrel) across temperatures for a type of projectile (e.g., cartridge, powder, gauge, or caliber). In at least one embodiment, a processor performing temperature profile generator 720 receives physical properties of the gun barrel (e.g., size, length, material of construction, diameter, thickness of walls, rifling) and temperature measurements from firing and uses those inputs to generate function, graph, or other representation of how temperature varies along length of the barrel. Temperature profile generator 720, performed by processor, can also receive heat conductive coefficients, heat transfer coefficients, and other properties of the gun barrel or constants that are used to generate a temperature profile. In at least one embodiment, temperature profile generator 720 can include software to perform finite element analysis for heat flow in a gun barrel based on the temperature measurements and properties of the gun barrel. Temperature profile generator 720 can include a neural network that is trained to generate temperature profiles, e.g., it receives training data for number of shots, temperature measurements of gun barrel, which is labeled and learns to predict what a temperature profile will be for a barrel given some temperature measurements and/or number of shots.

Gun properties 725 is a data structure, software, models, modules, and/or logic of a system, which a processor may use. Gun properties 725 may include equipment information. Equipment information includes a cartridge (e.g., projectile size and/or amount of charge), rifle design (e.g., weight, thickness, length, and/or diameter), trigger mechanics (e.g., stages of trigger used, weight of trigger, slack in trigger), and/or sight (e.g., amount of MOA per click rotation, such as ¼ MOA per ¼ turn "click," distance sighted in for, previous sight adjustments).

In at least one embodiment, aim algorithm 730 is a neural network. In at least one embodiment, a neural network can include a convolution neural network (e.g., receives temperature readings as inputs and outputs instructions for adjusting aim based on input), a diffusion network, recurrent neural network, a long short-term memory network, a gated recurrent unit network, an autoencoder, a generative adversarial network, transform network, or a combination thereof. Aim algorithm 730 is a data structure, software, models, modules, and/or logic of a system, which a processor may use. Aim algorithm 730 may include using temperature to calculate an amount of pressure applied to a projectile and/or the rate a charge burns for a cartridge, such as to predict muzzle velocity once fired. Then, an aim algorithm 730 may predict a trajectory based, at least in part, on a calculated ballistic coefficient for a round, weight, distance to target, equipment information (e.g., cartridge to include projectile size and/or amount of charge, manufacturer, rifle design), prior outcomes of a shot, and/or environmental conditions (e.g., wind, moisture, correct distance calculations attributing for altitude, and/or temperature). Aim algorithm 730 may then generate instructions (e.g., to adjust aim and/or sights) to a marksman.

In at least one embodiment, systems and methods disclosed herein can recommend a different type of ammunition based on gun parallel temperature. For example, where prolonged shooting leads to elevated gun barrel temperatures, a neural network can receive input temperatures and generate recommended selection of ammunition with propellants that exhibit stable burn rates across a wide range of temperatures.

In at least one embodiment, a system for generating training data to determine how gun barrel temperature affects bullet trajectory can be used (e.g., gun barrel temperature, results of shooting gun, and other labeled data that is provided to a train a neural network). For example, the disclosed technology can include electronic target systems utilize sensors in a target or along the bullet's path to detect the impact point, including relaying this information in real-time to a computer or display. As an another example, systems to generate training data can include optical scopes with graduated reticles that allow marksmen and observers to note the aim point at the moment of the shot, while high-speed cameras can capture the bullet's trajectory and impact point in detail. As another example, systems to generate training data can include laser boresights project a dot indicating where the barrel is pointing, aiding in aiming verification. As another example, systems to generate training data can include impact markers on targets, such as special coatings that change color upon bullet impact, provide a visual cue of the hit location. As another example, systems to generate training data can include a spotter with a high-powered scope who can observe and guide the shooter, while ballistic software and mobile apps predict the bullet's path based on various inputs. As another example, systems to generate training data can include radar and acoustic systems that track the bullet's flight and impact. In at least one embodiment, data from these systems can be labeled and combined with temperature sensor data to generate training data for neural networks.

As noted, the various methods may be described in the general context of computer-readable instructions stored on one or more computer-readable media. Computer-readable media are any available media that may be accessed within or by computing environment 200.

What is claimed is:

1. A non-transitory computer-readable medium storing instructions, which when executed by one or more processors, cause the one or more processors to:

receive an indication that a projectile will be fired;

receive a temperature measurement of a barrel that will fire the projectile;

identify an adjustment to modify aim of the projectile based, at least in part, on a temperature profile of the barrel when shooting projectiles with the barrel and the temperature measurement; and generate instructions to indicate how to modify the aim of the projectile based on the identified adjustment.

2. The non-transitory computer-readable medium of claim 1, wherein the instructions, which when executed by the one or more processors, further cause the one or more processors to:

identify a number of times the barrel has recently been used to fire projectiles;

identify an amount of time that has elapsed between each shot; and modify the adjustment to modify the aim based, at least in part, on the identified number of times and the amount of time that has elapsed between each shot.

3. The non-transitory computer-readable medium of claim 1, wherein the instructions, which when executed by the one or more processors, further cause the one or more processors to:

identify gun barrel information associated with a gun that will be shot; and modify the generated instructions based on the identified gun barrel.

4. The non-transitory computer-readable medium of claim 3, wherein the indication the projectile will be fired is based, at least in part, on one of the following:

receiving user input information;

receiving an image of the gun and identifying the gun barrel based on the image; and receiving properties of the gun barrel from a user.

5. The non-transitory computer-readable medium of claim 1, wherein the indication the projectile will be fired is based, at least in part, on one of the following:

receiving an indication from a mobile device;

identifying that a gun is being aimed; or receiving audio input that the gun will be shot.

6. The non-transitory computer-readable medium of claim 1, wherein the temperature measurement is based, at least in part, on a live measurement of the barrel.

7. The non-transitory computer-readable medium of claim 1, wherein the temperature measurement is based, at least in part, on previously acquired temperature measurement of the barrel after a number of shots.

8. The non-transitory computer-readable medium of claim 1, wherein the instructions, which when executed by the one or more processors, further cause the one or more processors to:

identify a location where a marksman is aiming to fire the projectile;

identify a desired target location where a user is aiming;

receive user input information to include projectile information; and modify the adjustment to modify the aim based, at least in part, on the desired target location, the identified desired target location, projectile information, and the temperature measurement.

9. The non-transitory computer-readable medium of claim 1, wherein the temperature profile includes a data structure that correlates muzzle velocity of the projectile with temperature variation along the barrel, the correlation being determined based, at least in part, on a firing history comprising timing and frequency of previously fired projectiles.

10. The non-transitory computer-readable medium of claim 1, wherein the temperature profile comprises a data structure that, for a given firearm model, maps one or more barrel locations and times to corresponding barrel temperatures and associated ballistic parameters, the temperature profile being generated from controlled test firings performed under recorded test conditions and comprising metadata identifying the firearm model, barrel identifier, caliber, and projectile type.

11. A method comprising:

receiving an identification of a barrel or one or more properties of the barrel;

accessing a temperature profile associated with the identification or the one or more properties of the barrel;

identifying an adjustment to modify aim of a projectile that will be guided by the barrel based, at least in part, on the temperature profile; and providing instructions to indicate how to modify the aim of the projectile based, at least in part, on the identified adjustment.

12. The method of claim 11, wherein providing the instructions is based, at least in part, on a number of times the projectile has been fired.

13. The method of claim 11, the method further comprising:

identifying a type of barrel that will be fired;

identifying a type of projectile that will be fired, and wherein providing the instructions is based, at least in part, on the identified type of barrel and projectile.

14. The method of claim 11, wherein providing the instructions is based, at least in part, on a predicted exit velocity of the projectile from the barrel.

15. The method of claim 11 wherein identifying the adjustment including using one or more neural networks to generate one or more outputs based, at least in part, on the temperature profile.

16. The method of claim 11, wherein identifying includes using one or more neural networks to generate a projected muzzle velocity for the projectile based, at least in part, on the temperature profile.

17. The method of claim 11, further comprising:

receiving temperature information and generating a prediction for one or more projectile trajectories;

indicating a temperature and a period of time until the barrel cools to a desired temperature.

18. A system, comprising:

a plurality of sensors to generate temperature information of a barrel; and a processor coupled to memory to store instructions, wherein the instructions, which when executed by the processor, cause the processor to:

receive an indication that a projectile is to be fired from the barrel;

receive a temperature measurement of the barrel from the plurality of sensors;

receive an identification of the barrel or one or more properties of the barrel;

access a temperature profile associated with the identification of the barrel or the one or more properties of the barrel;

determine an aim adjustment for the projectile based, at least in part, on the temperature profile and the temperature measurement; and generate one or more output instructions indicating the determined aim adjustment.

19. The system of claim 18, further comprising:

a graphical user interface to provide to a user the instructions to aim the projectile.

20. The system of claim 18, further comprising:

an audio device to generate output audio associated with the instructions to aim the projectile.

21. The system of claim 18, further comprising:

glasses to provide the output instructions to a user such that the user can view a target while the instructions are simultaneously displayed on the glasses.

22. The system of claim 18, wherein to generate is further based, at least in part, one or more neural networks that receive the temperature measurement and generate a projected muzzle velocity for the projectile.

* * * * *